United States Patent [19]

Rutishauser

[11] 4,364,551

[45] Dec. 21, 1982

[54] TRANSPORTATION DEVICE FOR SHEET-LIKE RECORDING CARRIERS

[75] Inventor: Thomas Rutishauser, Uerikon, Switzerland

[73] Assignee: Rutishauser Data AG, Stafa, Switzerland

[21] Appl. No.: 234,105

[22] Filed: Feb. 12, 1981

[30] Foreign Application Priority Data

Jun. 26, 1980 [DE] Fed. Rep. of Germany ..... 3024036

[51] Int. Cl.[3] ..... B65H 3/52

[52] U.S. Cl. ..... 271/121

[58] Field of Search ..... 271/121, 124, 125, 104, 271/137

[56] References Cited

U.S. PATENT DOCUMENTS

| | | | |
|---|---|---|---|
| 1,919,238 | 7/1933 | McCarthy | 271/124 X |
| 3,640,524 | 2/1972 | Fredrickson | 271/121 |
| 3,989,238 | 11/1976 | McCarthy | 271/124 |

FOREIGN PATENT DOCUMENTS

| | | | |
|---|---|---|---|
| 2518310 | 11/1976 | Fed. Rep. of Germany | 271/124 |
| 413779 | 12/1966 | Switzerland | 271/121 |

*Primary Examiner*—Richard A. Schacher

*Attorney, Agent, or Firm*—Cushman, Darby & Cushman

[57] ABSTRACT

An apparatus for conveying sheet-like recording carriers, such as paper, cards or envelopes without adjusting for their relative thicknesses is disclosed. In the conveying path of a sheet from a supply stack to a driven platen, a baffle plate and a deflecting surface are disposed as a separating device. The deflecting surface causes a pressure on the edge of the baffle plate to be exerted against the conveyed sheet due to the deflection by the deflecting surface. As a result, a sheet moving along beneath the conveyed sheet will abut with its forward edge against the surface of the baffle plate and is detained until the previously conveyed sheet vacates the baffle plate.

9 Claims, 3 Drawing Figures

TRANSPORTATION DEVICE FOR SHEET-LIKE RECORDING CARRIERS

BACKGROUND AND SUMMARY OF THE INVENTION

This invention relates to an apparatus for transporting sheet-like recording carriers such as sheets of paper, envelopes or the like. Such a transporting apparatus may be, for example, an assembly of an automatic recorder, a printer, or the like. The recording carriers may be, for example, sheets of writing paper, cards, envelopes or the like.

The increased popularity and widespread use of conventional automated business machines incorporating high speed printers has significantly increased the productivity and efficiency of office workers. The increased speed with which business machines now operate provide operators of such machines with an opportunity to accomplish additional tasks.

The major problem associated with these conventional automated business machines is the occasional double feeding of sheet-like recording carriers, such as, for example, sheets of paper to be printed upon.

Ideally, the conventional machines automatically feed single sheets of paper such that when the printing is finished upon one such sheet, an identical blank sheet immediately follows and is thus quickly positioned for further printing. This continuous flow of paper sheets thus provides for the automatic feeding and positioning of single sheets without the necessity of these sheets being manually positioned, thereby reducing the overall time required to accomplish a given task.

However, the conventional automated business machines do not always feed the required single sheets of paper. Often, a plurality of sheets are fed into the machine causing blockage of the conveying path as the sheets move through the machine. Thus, the blockage resulting from the plurality of sheets causes the machine to malfunction. The improperly fed sheets must be manually removed from the conveying path prior to the machine being, once again, ready for proper operation.

In an attempt to remedy the problem of feeding a plurality of sheets, it has been proposed, for example, in German OS No. 27 11 173, to provide a baffle plate as a separating device having a separating flap provided with friction-increasing coating. The separating flap is pressed by a weak spring in the direction of feed rolls, without, however, touching them. The lead slot formed between the feed rolls and the friction-increasing coating on the separating flap must be adapted to the thickness of the particular recording carrier to be conveyed. Thus, adjustments must be made depending upon the particular recording carrier utilized thereby obviating some of the advantages gained in automating the recording carrier conveyance. Also, such an arrangement is relatively expensive, due to the separating flap provided with the friction-increasing coating.

Furthermore, it has been proposed to make the sheets pulled off the supply stack, jump over separating corners. However, such an arrangement is suitable only for paper up to a certain stiffness and is not suited, for example, for the use of cards or envelopes. This arrangement also risks the formation of "dog's ears" or bent corners on the paper due to the separating corners. "Dog's ears" or bent corners are unacceptable to users of these devices since paper in this condition has a slovenly appearance. Additionally, it has also been proposed to use passage stops as a separating device. However, these passage stops must be adjusted to the particular thickness of the recording carrier being utilized.

According to the present invention, a transporting apparatus for sheet-like recording carriers is provided which makes possible a continuous conveyance of single sheets of recording carriers and/or envelopes of variable thickness. The sheets are singularly separated from a supply stack and are conveyed to a platen without special adaptation of the apparatus to the particular thickness of recording carrier being used.

The apparatus according to the present invention provides for the conveyed sheets and/or envelopes to be held by the deflecting plane against a baffle plate. In this manner, a possibly prematurely conveyed sheet is detained at its advancing edge at the edge of the baffle plate until the preceding sheet is conveyed past the baffle plate. The sheet thus obtained may then jump the baffle plate with its front edge, whereby it is likewise deflected by the deflecting plane and is held in a similar manner against the baffle plate.

Sheets and envelopes to be printed upon may be stacked alternatingly by such a device in the supply stack and then fed continuously to the platen. In this manner, letters and their corresponding envelopes, for example, may be quickly and efficiently prepared and collated. By utilizing the present invention, a resetting for different thicknesses is not necessary. Similarly, it is also possible to convey sheets or cards of variable thicknesses in any sequence.

In a preferred embodiment of the present invention, the baffle plate may have a plane which, as compared to the vertical, is angularly slanted in the direction of the path of conveyance. As a result of the slanting position, it is easier for the sheet being detained to jump the baffle plate with its forward edge when a previously conveyed sheet vacates.

Since the baffle plate is to be disposed in the immediate vicinity of the stop surface, it is preferable that the baffle plate is attached to the element having the stop surface. More preferably, the baffle plate may be disposed in the middle of the conveying path in order to ensure a symmetrical load of the sheets to be conveyed during their separation.

The deflecting element may also be rearwardly extended in the direction of the supply stack and may be arched away from the supply stack. This embodiment thus provides an intake slot or gap between the surface of the deflecting element and the element having the stop surface. The intake gap, however, should be selected large enough so that even thick recording carriers are conveyed easily. This intake gap, therefore, serves for supporting the separating device, in which an upward by-pass of the sheets pulled off the supply stack, is prevented.

DETAILED DESCRIPTION OF THE DRAWINGS

Figure 1:
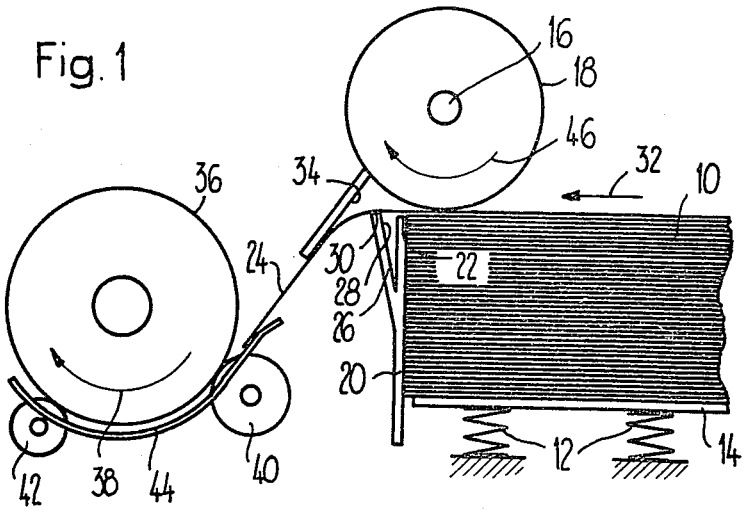
FIG. 1 shows an apparatus for transporting sheet-like recording carriers with a planar deflecting surface.

Referring specifically to FIG. 1 there is shown a supply stack 10 of recording carriers, such as for example, sheets, cards and/or envelopes. A bias is exerted on this supply stack 10, by means of fixedly supported springs 12, through a base plate 14, against a set of conveying rollers 18, consisting of at least two rollers, disposed on a common shaft 16. The forward plane defined by supply stack 10, abuts the stop element 20 in the direction of the path of conveyance. The top edge 22, of stop element 20, is slightly below the top sheet 24 of supply stack 10. The relative position of the top sheet 24 is determined by the position of the set of conveying rollers 18.

A baffle plate 26, projecting into the path of conveyance of the sheet 24 is fixedly attached to stop element 20. Baffle plate 26 has a surface 28 with a top edge 30. Surface 28, relative to the perpendicular of the direction of the path of conveyance 32 is angled in the direction of the path of conveyance. Edge 30 projects slightly into the path of conveyance of sheet 24.

Deflecting surface 34 is inserted after the baffle plate 26 in the direction of the path of conveyance 32. This deflecting surface 34 is angled relative to the original direction of the path of conveyance 32, in order to deflect the conveyed sheet such that it is held against edge 30 of baffle plate 26. The deflecting surface 34 is directed tangentially of the intake side of platen 36.

Contact rolls 40 and 42 as well as a baffle 44 are assigned to the platen 36 and are driven in the direction of arrow 38.

Subsequently, the method of operation of the transportation device will be described in more detail. The set of rolls 18 is driven in the direction of rotation 46, and always pulls off the top sheet 24 from the supply stack 10 in the direction of conveyance 32. At the same time, the conveyed sheet is guided over the top edge 30 of the baffle plate 26 and is deflected by the deflecting surface 34 toward the platen 36. As a result of the deflection, a bending force is exerted on the sheet 24, as a result of which the latter touchingly crosses the edge 30 of the baffle plate 26. Should, in the course of conveyance, the sheet lying beneath sheet 24, be pulled along through friction, then its leading edge will abut against the surface 28 of the baffle plate 26 below the edge 30. The distance between the stop element 20 and the baffle plate 26 is relatively small, so that the abutting sheet despite friction on the conveyed sheet 24 lying above it, may not bend. As a result of the slanted position of the surface 28 of the baffle plate 26, the leading edge of the sheet which is pulled along, is guided upward, but is held back at the edge 30 of the baffle plate 26, until the conveyed sheet 24 has passed the baffle plate 26. Only then can the sheet which was pulled along, pass with its leading edge, the edge 30 of the baffle plate 26.

For a smooth functioning of the separating device, consisting of the elements 26, 28, 30 and 34, particular importance is to be assigned to the tilted positioning of the surface 28 of the baffle plate 26. Furthermore, the edge 30 obviously must be angular relative to the surface 28 of the baffle plate 26. Preferably, the baffle plate 26 and the deflecting surface 34 are disposed in the middle of the sheets that are to be conveyed and must be synchronized in their width.

The method of operation of this separating device is based especially on the fact that a contact pressure is produced by the deflecting surface 34 against the top edge 30 of the baffle plate 26. Whenever this contact pressure is omitted, then the next following sheet may pass the baffle plate. The device described makes possible a reliable separation of sheets, cards and/or envelops of variable thickness.

Figure 2:
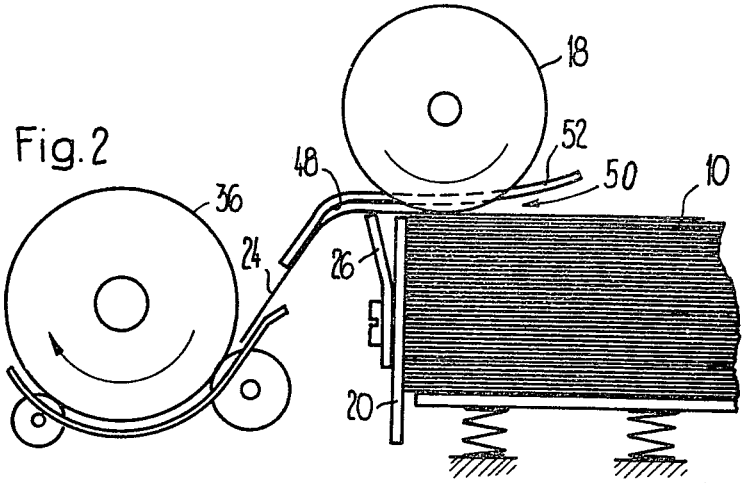
FIG. 2 shows a similar apparatus having an arched deflecting surface and an intake gap.

FIG. 2, shows another embodiment, whereby the deflecting surface 48, is arched and extended in the direction of the supply stack 10, so that, together with the top edge 22 of the stop element 20, an intake gap 50 into the path of conveyance is formed. Furthermore, the extension 52 of the deflecting surface 48 is developed such, that a funnel-like intake is formed above the supply stack 10.

Figure 3:
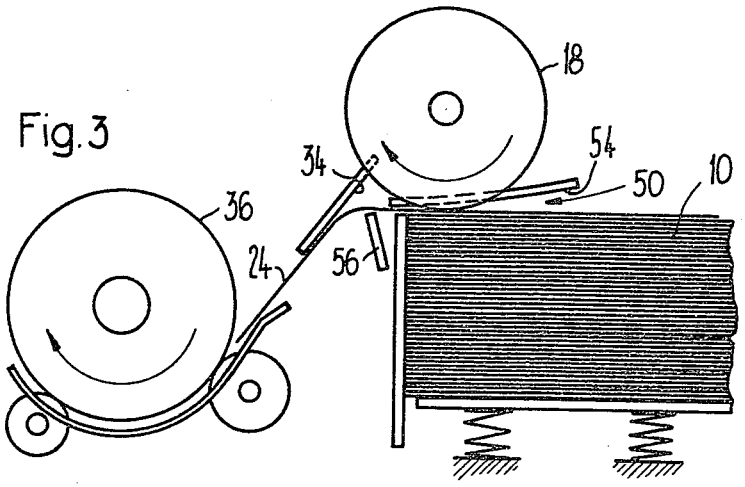
FIG. 3 shows a similar apparatus having a planar deflecting surface and a limiting element for the intake gap, independent of the deflecting surface.

FIG. 3 shows an additional embodiment, in which an intake surface 54 is disposed above the supply stack 10 independently of the deflecting surface 34. A baffle plate 56 is disposed independently of the contact element 20.

It is self-evident that the arrangement shown, may also be arranged inversely relative to the stop element 20, the baffle plate 26 and the deflecting surface 34, whenever the set of rolls 18 is beneath the supply stack, so that the bottom sheet of such an embodiment is carried away from the supply stack.

The baffle plate 26, 56 and the deflecting surface 34, 48 are disposed rigidly relative to the stop element 20. Thus, the separating device has no movable parts and is, therefore, very simple in its structure despite its campatability with recording carriers of variable thickness. A separating device of the present invention may be attached subsequently to existing transportation arrangements.

While the invention has been herein described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent assemblies and methods thereof.

What is claimed is:

1. An apparatus having means for successively removing sheet-like recording carriers from a supply stack and for conveying the carriers into a predetermined path, means for biasing the stack so that the carrier at one end of the stack is urged into engagement with the removing and conveying means and stop means engageable with the forward edge of the supply stack relative to the path, the combination of means for assuring successive conveyance of the carriers one-by-one in the predetermined path, comprising:

a first element disposed along the path beyond the stop means on the opposite side of the path from the removing and conveying means, said element having an edge engageable and transversable by a carrier traveling along the path and having a surface facing the stack and extending from said element edge away from the path at an inclination toward the stack; and a second element disposed along the path and on the same side thereof as the removing and conveying means, said second element having a surface disposed along the path beyond said first element, said surface being engageable by a carrier and inclined in the direction of movement thereof to deflect the carrier and hold it against said edge of said first element; whereby if two carriers are removed at once from the stack and traverse the stop means, the forward edge of the second carrier will abut said surface of said first element and be prevented from passing over said edge thereof by the first carrier until the latter becomes free from engagement with the removing and conveying means.

2. An apparatus as recited in claim 1 wherein the first and second elements are fixedly disposed relative the stop element.

3. An apparatus as recited in claim 2 wherein the first element is fixedly connected to the stop element.

4. An apparatus as recited in claim 1 wherein there are a plurality of the first and second elements symmetrically disposed transversely of the path.

5. An apparatus as recited in claim 1 wherein a portion of the second element extends rearwardly relative to the path to overlap the supply stack opposite the stop element, and defines with the edge of the stop element an intake slot for the sheet-like recording elements.

6. An apparatus as recited in claim 5 wherein the rearwardly extending portion of the second element curves away from the supply stack.

7. An apparatus as recited in claim 1 further comprising a limiting element angularly disposed relative to the surface of the supply stack and positioned opposite the stop element to define an intake slot for the sheet-like recording carriers.

8. An apparatus having means for successively removing sheet-like recording carriers from a supply stack and for conveying the carriers into a predetermined path, means for biasing the stack so that the carrier at one end of the stack is urged into engagement with the removing and conveying means and stop means engageable with the forward edge of the supply stack relative to the path, the combination of means for assuring successive conveyance of the carriers one-by-one in the predetermined path, comprising:

a first element disposed along the path beyond the stop means on the opposite side of the path from the removing and conveying means, said element being engageable and transversable by a carrier traveling along the path, and a second element disposed along the path and on the same side thereof as the removing and conveying means, said second element having a surface disposed along the path beyond said first element, said surface being engageable by a carrier and inclined in the direction of movement thereof to deflect the carrier and hold it against said first element; whereby if two carriers are removed at once from the stack and traverse the stop means, the forward edge of the second carrier will abut said first element and be prevented from traversing the same by the first carrier until the latter becomes free from engagement with the removing and conveying means.

9. An apparatus as recited in claim 8 wherein the first and second element are symmetrically disposed with respect to the width of the path.

* * * * *